US009766035B2

(12) United States Patent
Storch

(10) Patent No.: US 9,766,035 B2
(45) Date of Patent: Sep. 19, 2017

(54) FIREARM ACCESSORY MOUNTING ADAPTERS

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

(21) Appl. No.: 14/610,090

(22) Filed: Jan. 30, 2015

(65) Prior Publication Data

US 2016/0223286 A1 Aug. 4, 2016

(51) Int. Cl.
*F41C 23/16* (2006.01)
*F41G 11/00* (2006.01)
*F41C 27/00* (2006.01)

(52) U.S. Cl.
CPC ..... *F41C 23/16* (2013.01); *F41G 11/001* (2013.01); *F41C 27/00* (2013.01)

(58) Field of Classification Search
CPC ..... F41C 23/16; F41C 27/00; F41G 11/003–11/008
USPC ..... 42/71.01, 72, 124, 125, 127; 89/14.1, 89/14.2, 125; 224/150
See application file for complete search history.

(56) References Cited

U.S. PATENT DOCUMENTS 3,798,818 A * 3/1974 Casull ..... F41C 23/12 42/72
5,375,361 A * 12/1994 Rustick ..... F41G 11/003 42/125
6,499,245 B1 * 12/2002 Swan ..... F41C 23/00 42/124
7,096,620 B2 * 8/2006 Zeh ..... F41G 11/001 42/124
7,191,557 B2 * 3/2007 Gablowski ..... F41C 23/16 42/72
7,444,776 B2 * 11/2008 Adams ..... F41G 11/001 42/124
7,707,762 B1 * 5/2010 Swan ..... F41C 23/16 42/105
7,802,392 B2 * 9/2010 Peterson ..... F41A 11/02 42/124
7,836,625 B2 * 11/2010 Swan ..... F41C 23/16 42/127
8,201,353 B1 * 6/2012 Swan ..... F41C 23/16 42/71.01
8,215,046 B2 * 7/2012 Chvala ..... F41C 23/16 42/124
8,468,733 B2 * 6/2013 Deros ..... F41G 11/003 42/90
8,650,794 B2 * 2/2014 Swan ..... F41C 23/02 42/106
8,752,320 B2 6/2014 Masters
(Continued)

*Primary Examiner* — John D Cooper
(74) *Attorney, Agent, or Firm* — Boyle Fredrickson, SC

(57) ABSTRACT

A system for manipulating the engagement interface associated with securing accessories to a firearm. The system includes at least one accessory mount adapter that includes a first side that is constructed to cooperate with an engagement interface defined by a structure, such as a hand guard, that is securable to a firearm. A second side of the adapter defines a second engagement interface that is different than the first engagement interface and is configured to removably cooperate with a firearm accessory.

7 Claims, 9 Drawing Sheets

(56) References Cited

U.S. PATENT DOCUMENTS

| | | | | |
|---|---|---|---|---|
| 8,806,792 | B2 * | 8/2014 | Yan | F41C 23/16 42/71.01 |
| 8,819,980 | B2 * | 9/2014 | Geissele | F41C 23/16 42/71.01 |
| 9,157,696 | B2 * | 10/2015 | Dextraze | F41G 11/003 |
| 9,222,756 | B1 * | 12/2015 | Battaglia | F41C 27/00 |
| 9,239,209 | B2 * | 1/2016 | Mayberry | F41G 11/005 |
| 9,239,210 | B2 * | 1/2016 | Mayberry | F41C 23/16 |
| 9,297,609 | B2 * | 3/2016 | Burt | F41C 23/16 |
| 9,341,441 | B2 * | 5/2016 | Cheng | F41C 27/00 |
| 9,377,274 | B2 * | 6/2016 | Kincel | F41G 11/003 |
| 9,404,714 | B2 * | 8/2016 | Langevin | F41C 23/16 |
| 2004/0000083 | A1 | 1/2004 | Grant, Jr. | |
| 2005/0217161 | A1 | 10/2005 | Haugen et al. | |
| 2006/0053673 | A1 | 3/2006 | Murello | |
| 2009/0038198 | A1 | 2/2009 | Yu | |
| 2012/0167434 | A1 * | 7/2012 | Masters | F41C 23/16 42/90 |
| 2013/0074394 | A1 * | 3/2013 | Larue | F41G 1/28 42/111 |
| 2014/0041273 | A1 * | 2/2014 | Masters | F41C 23/16 42/71.01 |
| 2014/0130390 | A1 * | 5/2014 | Geissele | F41C 23/16 42/71.01 |

* cited by examiner

FIREARM ACCESSORY MOUNTING ADAPTERS

BACKGROUND OF THE INVENTION

The present invention relates generally to devices and mechanisms for attaching auxiliary devices or accessories such as lights, sights, etc. to a firearm. More specifically, the present invention relates to devices and methods for alternating an engagement interface associated with securing accessories to a hand guard secured to an underlying firearm.

Firearm accessory rails, such as the widely used picatinny rail, which is commonly identified as a MIL-STD-1913 rail, STANAG 2324 rail, or tactical rail, provide a heavily accepted standardized platform for attaching auxiliary devices or accessories to a firearm. Such accessories can include sights, telescopic sights, magnifiers, lights, night vision devices, ammunition clips, auxiliary supports such as bipods and/or tripods, for example. Such accessory rails are commonly secured to a firearm to provide a platform that allows the user to easily modify a firearm configuration by quickly attaching and/or detaching desired accessories to and from the projections associated with the respective rails to achieve a desired configuration of the firearm. Many such accessories are configured to tool-lessly cooperate with the underlying rail to improve the efficiency with which the desired accessories can be associated with the underlying firearm.

Generally, accessories are coupled to accessory rails by utilizing accessory adapter devices, which are secured to the respective accessory and configured to releasably cooperate with the rails. Once an accessory is coupled to an adapter device, the releasable locking mechanism of the adapter device allows a user to modify the configuration of the firearm by selectively attaching, detaching, and reattaching the adapter device to the underlying firearm in a desired position and as a given situation may dictate.

Although picatinny rail and associated adapter devices provide the advantage of quick field modification of firearm configurations, such accessory mounting methodologies present several disadvantages. For instance, picatinny rail configurations are generally rigid closed form bodies. The rail sections commonly extend along a forward portion of the firearm and are commonly referred to as a hand guard in that the rail sections prevent contact between the barrel portion of the firearm and the forward oriented hand of the shooter. The closed elongated form of such accessory mounting rails tends to substantially increase the weight of the firearm equipped with such accessory rails. Further, picatinny accessory rails are limited to cooperation with picatinny compliant adapter devices and the accessories associated therewith. That is, accessories must be configured for cooperation or interaction with a picatinny rail prior to utilization of the accessory with a firearm equipped with a picatinny mounting rail.

Recognizing the shortcomings associated with the weight of picatinny accessory mounting rails and/or hand guards that incorporate the same, others provide hand guards that are constructed to cooperate with a firearm but which include more open space associated with the construction of the hand guard assembly. Generating the open spaces reduces the weight of the hand guard but requires cooperation with non-picatinny compliant adapter devices to facilitate the secure connection of accessories with the underlying hand guard.

One such hand guard construction or accessory mounting interface that includes a number of open spaces to reduce the weight associated with the hand guard or accessory mount adapter is commonly known as an M-Lok® interface. The M-Lok® engagement interface includes a number of elongated channels or grooves that are generally oriented in rows aligned with a longitudinal axis of the band guard. Accessory mounting adapters are secured to rail sections via a fastener and nut pair that cooperate with a respective channel for securing accessories or accessory mounting devices to the rail. Each channel associated the M-Lok® engagement interface is longitudinally and laterally symmetric relative to the centerline axis of the respective channel.

Another hand guard or accessory mounting device engagement interface configuration intended to reduce the weight associated with securing accessories to a firearm is commonly referred to as a KEYMOD® attachment system. Like the M-Lok® interface, the KEYMOD® interface includes a plurality of elongated channels or grooves that are oriented in rows along the longitudinal length of the hand guard or accessory mounting system wherein the number of channels are symmetrical relative to a longitudinal axis of each channel.

Unlike the M-Lok® engagement interface, the channels or openings of the KEYMOD® engagement interface are asymmetrical with respect to centerline axis of the respective channel that is perpendicular to the longitudinal axis. That is, one end of the elongated channel associate with the KEYMOD® engagement interface has a larger footprint than the opposing end of the respective channel. Commonly, the end associated with the larger footprint portion of the channel is located more rearward than the other end relative to the direction of the muzzle of the underlying firearm. Both the M-Lok® interface and the KEYMOD® interface can provide dramatic weight savings as compared to picatinny rail engagement interfaces but both systems suffer from a drawback common to picatinny rail engagement interfaces, M-Lok® engagement interfaces, and KEYMOD® engagement interfaces.

Each of the rails and accessory adapter devices associated with the picatinny rail engagement interfaces, M-Lok® engagement interfaces, and KEYMOD® engagement interfaces are configured to cooperate with accessory mounting devices that are constructed to cooperate with only one of the underlying engagement interfaces. That is, the shape, spacing, and orientation of the various openings or channels and the adjoining projections or rigid structures associated with each of the engagement interface configurations is sufficiently unique so as to require a mating device have a generally unique mating construction or interface configuration to accommodate the secure connectivity between the respective connectable portions associated with the respective interface configurations. That is, accessory mounting devices configured to cooperate with one of a picatinny rail engagement interface, M-Lok® engagement interface, and KEYMOD® engagement interface are generally incapable of securely cooperating with others of the picatinny rail engagement interface, M-Lok® engagement interface, and KEYMOD® engagement interface.

For instance, a user having a firearm equipped with a mounting rail having a particular engagement interface configuration, commonly has various accessories and associated accessory mounting devices that are configured to removably cooperate with the particular engagement interface. Converting the engagement interface associated with the firearm to another of the picatinny, M-Lok®, or KEYMOD® engagement interfaces, requires the user to convert each accessory, if such an accessory mounting device is even available, to the mating portion associated with the corresponding engagement interface. Such a consideration nearly entirely negates any infield alteration of the accessory mounting platform and limits use of any unexpectedly, available accessories with a respective firearm unless such accessories are already configured for cooperation with the underlying engagement interface associated with the firearm. Such a consideration also negates any sharing of discrete accessories unless both parties to the exchange have a firearm equipped with the same accessory mounting engagement interface and/or a respective adapter configured to cooperate with a respective accessory. The latter of which would commonly require in-field separation of the accessory from the mounting interface and association of the accessory with the alternative mounting interface adapter rendering the association susceptible to lost parts and/or commonly requiring the availability of various tools to effectuate the separation between the accessory and the underlying respective adapters.

Therefore, there is a need for a firearm accessory mount adapter and system platform that can securely cooperate with a first engagement interface configuration, such as the M-Lok® or KEYMOD® engagement interface configuration, and which provides a second engagement interface configuration in the other of an M-Lok® or KEYMOD® engagement interface configuration.

SUMMARY OF THE INVENTION

The present invention provides a system and firearm accessory mount adapter that overcomes one of more the aforementioned drawbacks. One aspect of the invention discloses a system that includes at least one accessory mount adapter. The adapter includes a firearm facing or second side that is constructed to cooperate with an engagement interface configuration defined by a structure, such as a hand guard, that is securable to a firearm. An outward facing, atmosphere facing, or first side of the adapter defines a second engagement interface configuration that is different than the first engagement interface configuration and is configured to removably cooperate with a firearm accessory or mounting device secured to the accessory.

Another aspect of the invention that is usable with one or more of the above features or aspects discloses a firearm accessory mount adapter that includes a one-piece body defined by a longitudinal axis. The one-piece body includes a first side and a second side that are opposite one another and that each extend along the longitudinal axis. At least one projection extends from the first side of the one-piece body and is shaped to cooperate with an opening defined by a hand guard that is securable to a firearm. At least one cavity is associated with the second side of the one-piece body such that the at least one cavity is defined by a closed radial perimeter defined by the one-piece body. A passage is formed through the one-piece body at a location that is offset along the longitudinal axis from the at least one cavity. The passage is shaped to cooperate with a fastener that is configured to secure the one-piece body relative to the hand guard. The first side of the one-piece body is shaped to cooperate with a first engagement interface configuration defined by the hand guard and the second side of the one-piece body defines a second engagement interface configuration that is different than the first engagement interface configuration and wherein neither the first engagement interface configuration or the second engagement interface configuration include open ended channels such as those formed by a picatinny rail engagement interface configuration.

A further aspect of the invention that is combinable with one or more of the above aspects or features discloses a firearm accessory mounting system. The system includes a hand guard that is configured to extend about a portion of a barrel of a firearm. A first engagement interface is defined by a portion of the hand guard and further defined by a plurality of guard channels that extend in a row along the hand guard such that a longitudinal axis of each guard channel is aligned along a longitudinal axis of the row of guard channels. Each of the plurality of guard channels associated with the first engagement interface are further defined as being symmetric relative to a longitudinal axis associated with the row and one of symmetric or asymmetric relative to a lateral axis oriented perpendicular to the longitudinal axis of the row. The system includes an adapter having a first side that is shaped to cooperate with the first engagement interface at various locations along the row and a second side that faces an opposite direction with respect to the first side. The second side of the adapter defines a second engagement interface that is defined by a plurality of adapter channels that extend in an adapter channel row along the adapter such that a longitudinal axis of each adapter channel is aligned along the longitudinal axis of the adapter channel row. Each of the plurality of longitudinal adapter channels associated with the second engagement interface are further defined as being symmetric relative to the longitudinal axis associated with the adapter channel row and the other of symmetric or asymmetric relative to a lateral adapter axis that is oriented perpendicular to the longitudinal axis of the respective adapter channel and perpendicular to the longitudinal axis of the row of longitudinal channels associated with the first engagement interface.

A further aspect of the invention that is combinable with one or more of the above aspects or features discloses a kit for manipulating an engagement interface configuration between a firearm accessory and a hand guard associated with a firearm. The kit includes at least one adapter that is defined by a one-piece body. The one-piece body has a first side that is shaped to cooperate with a first engagement interface configuration formed by a hand guard and a second side that is opposite the first side. A projection extends in an outward direction from the first side of the body and cooperates with the first engagement interface configuration that is defined by a plurality of elongated grooves that are each configured to cooperate with the projection. The plurality of grooves are oriented in a row such that a longitudinal axis of each groove is aligned with a longitudinal axis of the row and each of the elongated grooves is symmetrical with respect to the longitudinal axis and one of symmetrical or asymmetrical with respect to a centerline axis of a respective groove that is perpendicular to the longitudinal axis. The second side of the at least one adapter includes at least one elongated opening defined by a longitudinal axis oriented to be aligned with the longitudinal axis associated with the plurality of elongated grooves and a centerline lateral axis that is oriented transverse to the longitudinal axis of the elongated opening. The elongated opening is further defined as being symmetrical relative to the longitudinal axis of the elongated opening and the other of symmetrical or asymmetrical with respect to the centerline lateral axis of the at least one elongated opening to define a second engagement interface configuration that is different than the first engagement interface configuration.

These and other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
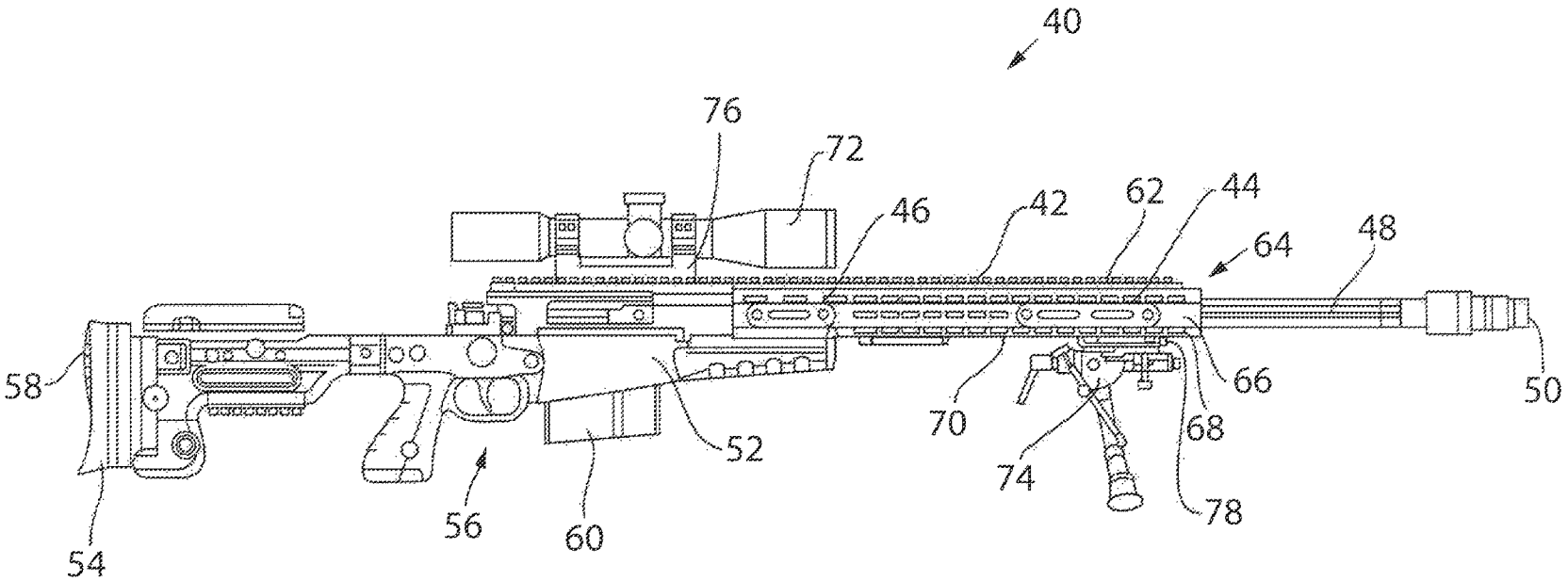
FIG. 1 is a side elevation view of an exemplary firearm equipped with a plurality of accessory mount adapters according to one embodiment to the present invention.

FIG. 1 shows a firearm 40 equipped with an exemplary hand guard 42 and having various accessory mount adapters 44, 46 according to embodiments of the present invention secured thereto. Firearm 40 includes a barrel 48 that extends between a muzzle 50 and a receiver 52. A stock 54 extends generally rearward of receiver 52. Receiver 52 supports a trigger assembly 56 such that trigger assembly 56 is disposed between a butt 58 defined by stock 54 of firearm 40 and barrel 48. Firearm 40 includes a magazine 60 associated with accommodating various rounds of ammunition. As is commonly understood, user interaction with trigger assembly 56 is associated with discharging firearm 40.

Hand guard 42 extends along barrel 48 generally forward of receiver 52 and includes one or more rows of engagement interfaces 62, 64, 66, 68, 70 associated with securing accessories to firearm 40. One or more accessories 72, 74, such as a scope 72 and a bi-pod 74, are associated with a respective accessory mount devices 76, 78 that is disposed between the respective accessory 72, 74 and the underlying accessory engagement interface. Each accessory mount device 76, 78 is constructed to securely cooperate with a respective engagement interface 62, 64, 66, 68, 70 associated with the underlying hand guard 42. Although shown as a scope and a bi-pod, it is appreciated that various accessories, such as lights, other sighting devices, supplemental munitions, etc., can be supported hand guard 42 provided the respective accessories are configured to cooperate with or be secured to a respective engagement interface 62, 64, 66, 68, 70 defined by hand guard 42. It is further appreciated that the rotational and longitudinal position of the desired accessories can be manipulated relative to hand guard 42 provided the desired engagement interface 62, 64, 66, 68, 70 defined by hand guard 42 is configured to cooperate with the accessory mount device 76, 78 associated with the underlying accessory.

Figure 2:
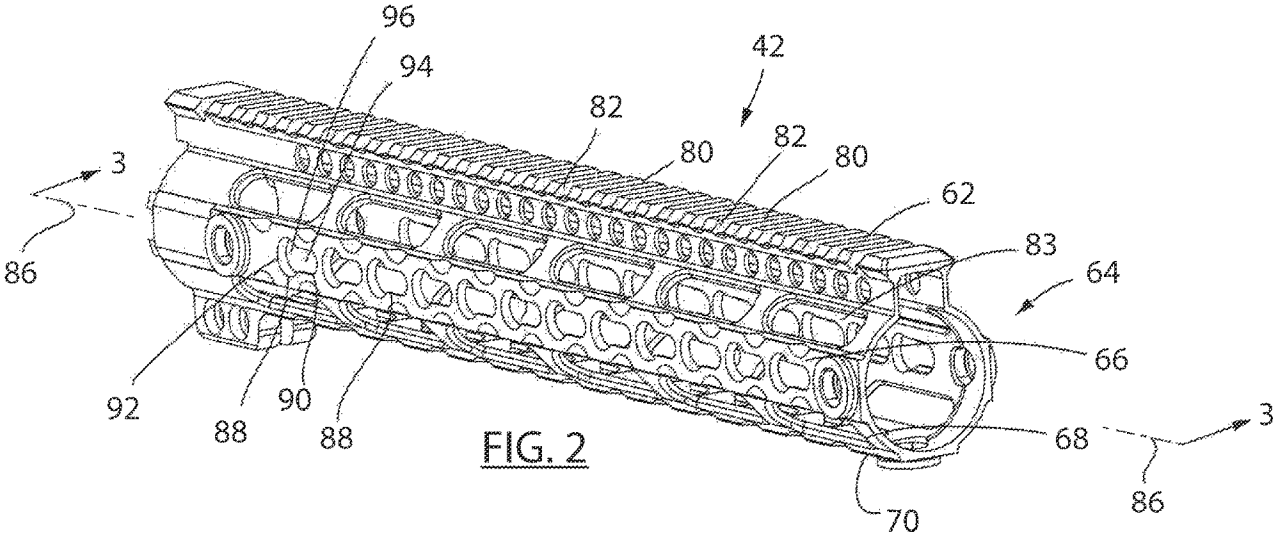
FIG. 2 is a perspective view of a hand guard removed from the firearm shown in FIG. 1.
Figure 3:
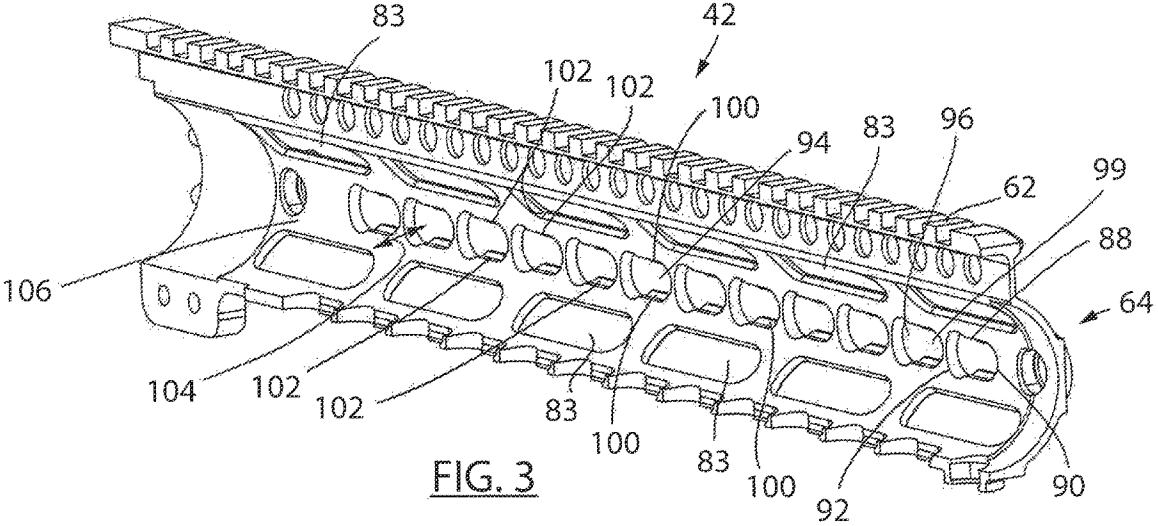
FIG. 3 is a longitudinal cross section view of the hand guard shown in FIG. 2.

FIGS. 2 and 3 show hand guard 42 removed from firearm 40. Engagement interface 62 generally defines a picatinny rail engagement interface section. Such rails are defined by a number of ridges 80 that are separated from one another by a number of channels 82. The opposite lateral ends of channels 82 are generally open in opposite lateral directions relative to the longitudinal axis, indicated by line 86, of hand guard 42. Engagement interfaces 62, 64 are disposed on the opposite lateral sides of hand guard 42 and include a plurality of openings 88 that are oriented in a row aligned with axis 86. Said in another way, hand guard 42 defines a number of engagement interfaces that extend longitudinally along the hand guard 42 and are offset from one another in a circumferential direction about the exterior surface of hand guard 42.

Hand guard 42 includes a number of openings 83 that are formed through the hand guard at areas offset from the respective rows of engagement interfaces 62, 64, 66, 68, 70 so as to further reduce the weight associated with hand guard 42 but so as to maintain the structural integrity of the same. It is further appreciated that rows of openings 83 may be configured to accommodate the removable connection of the accessory mounting devices therewith, but commonly, accessories associated with the orthogonally oriented engagement interface surfaces 62, 64, 66, 68, 70 are sufficient to achieve a desired configuration of firearm 40 and provide a fairly compact association of accessories when associated therewith.

Commonly, the non-picatinny rail engagement interfaces defined by any given hand guard are provided in a common configuration. That is, such hand guards 42 are commonly configured to cooperate with accessory mounting devices having a common engagement interface configuration such as a KEYMOD®, KEYMOD® like, M-Lok®, M-Lok® like, or other longitudinally repeating but uniform engagement interface. Such a methodology allows an underlying firearm to be quickly configured for use by left handed or right handed users with a common set of accessories or accessories that can be secured to alternate sides of the hand guard. Unfortunately, such a methodology limits the use of accessories having other engagement interface configurations with hand guard 42 without substantial reconfiguration of the firearm, the hand guard, or changing of the discrete accessory mounting devices.

With respect to hand guard 42, and specifically the non-picatinny rail engagement interfaces 64, 68, each opening 88 includes a forward facing end 90 and a rearward facing end 92 relative to the longitudinal axis 86 of hand guard 42. A forward portion 94 of each opening 88 is generally defined by a reduced diameter or width as compared to a rearward portion 96 of each opening 88. As should be appreciated from FIG. 2, each of openings 88 of engagement interface 66 is symmetrical relative to the longitudinal axis of the respective opening and non-symmetrical relative a lateral axis of the respective opening due to the disparities between the shapes of forward portion 94 and rearward portion 96 of each opening 88.

Referring to FIG. 3, a lip 100 generally overlies the forward portion 94 of each opening 88 to define a recess or step 102 associated with each forward portion 94 of each respective opening 88. Each step 102 is defined as extending in a crossing direction, indicated by arrow 104 relative to a body 106 of hand guard 42. As explained further below, each opening 88 is shaped to slidably cooperate with a fastener assembly and/or a boss or projection associated with an accessory mount adapter engaged with the respective engagement interface.

Figure 4:
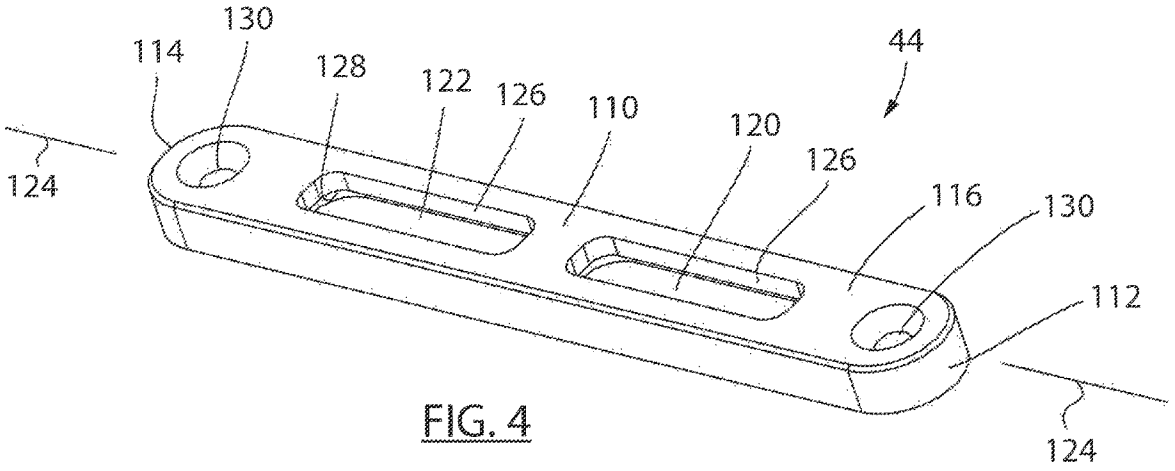
FIG. 4 is a perspective top view of an accessory mount adapter shown in FIG. 1 removed from the hand guard.
Figure 5:
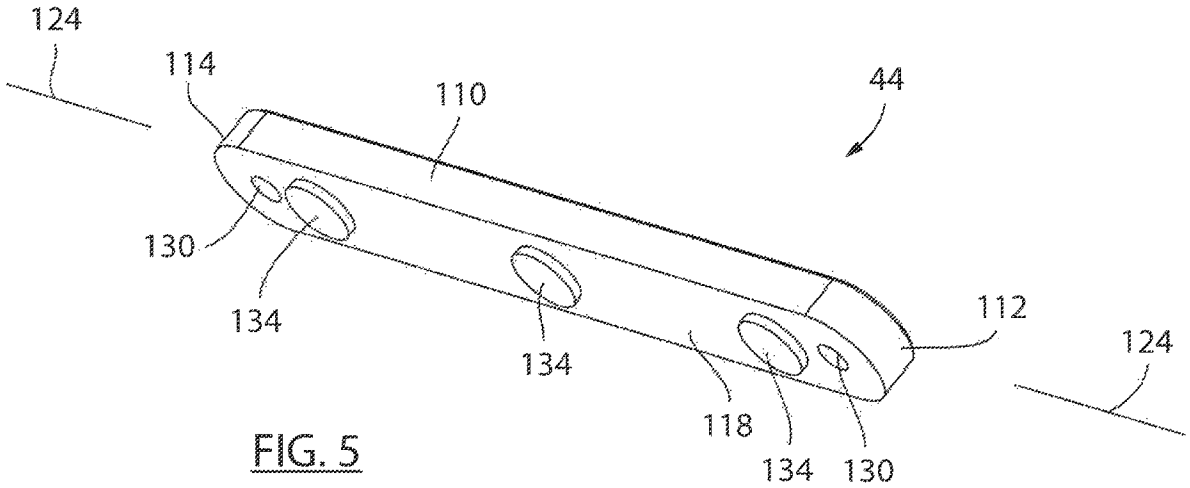
FIG. 5 is a perspective bottom view of the accessory mount adapter shown in FIG. 4.
Figure 6:
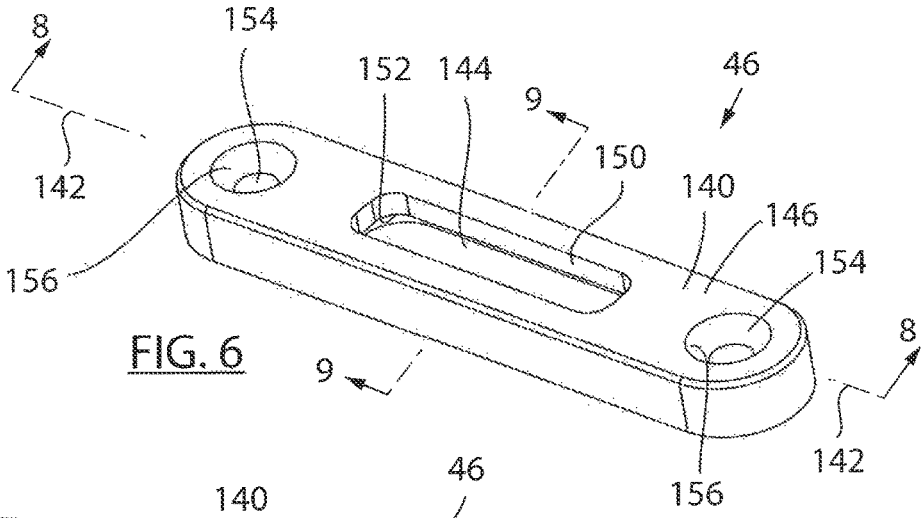
FIG. 6 is a view similar to FIG. 4 of another accessory mount adapter shown in FIG. 1 removed from the hand guard.
Figure 7:
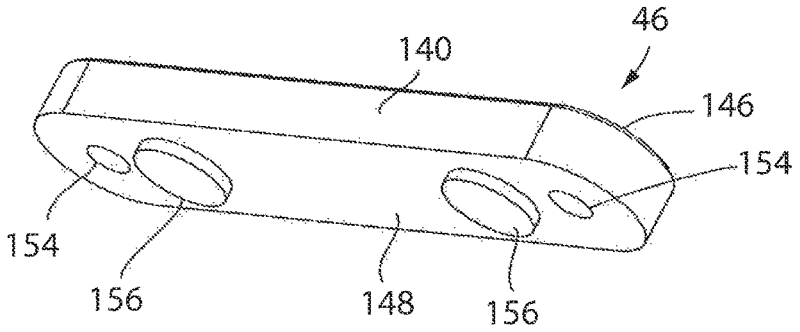
FIG. 7 is view similar to FIG. 5 of the accessory mount adapter shown in FIG. 6.

FIGS. 4 and 5 show accessory mount adapter 44 removed from hand guard 42. Adapter 44 is defined by a body 110 that extends in a longitudinal direction between a first end 112 and a second end 114 of the body 110. Body 110 defines a first or top side 116 and a second or bottom side 118 that are defined as opposite facing sides of adapter 44. Top side 116 is configured to be exposed to atmosphere when second side 118 of adapter 44 is engaged with an engagement interface 64, 66, 68 of hand guard 42. Adapter 44 includes a first opening 120 and a second opening 122 that extend in a crossing direction relative to sides 116, 118 of body 110. Openings 120, 122 have a generally elongated shape that is aligned with longitudinal axis, indicated by line 124, of body 110. Each opening 120, 122 is defined by a circumferential perimeter 126 defined by the termination of body 110 proximate the respective opening 120, 122. Each opening 120, 122 defines a lip, groove, or shoulder 128 that is shaped to cooperate with a fastener assembly, or other securing arrangement associated with receiving an accessory mount device. It is envisioned that openings 120, 122 can extend completely through body 110 or define blind holes formed therein. Body 110 includes one or more through holes 130 that extend through body 110 in a direction crossing sides 116, 118. Through holes 130 are constructed to cooperate with a fastener assembly configured to secure accessory mount adapter 44 relative to a suitably configured underlying engagement interface 64, 66, 68 defined by hand guard 42.

Referring to FIG. 5, side 118 of body 110 includes one or more bosses, indexers, or projections 134 that extend in an outward direction generally transverse to side 118 relative to axis 124 of body 110 of accessory mount adapter 44. Projections 134 are oriented along side 118 of body 110 so as to cooperate with respective openings 88 defined by a respective engagement interface 64, 66, 68 defined by hand guard 42. It is appreciated that the shape of projections 134 can be provided to cooperate with either of portions 94, 96 of respective openings 88. The cooperation between projections 134 and respective openings 88 allows accessory mount adapter 44 to be quickly indexed relative to the desired row of engagement interfaces 64, 66, 68 associated with hand guard 42 when accessory mount adapter 44 is intended to be secured thereto.

As disclosed further below with respect to FIG. 20, once accessory mount adapter 44 is oriented in a desired position relative to hand guard 42, cooperation of a fastener assembly with respective openings 130 of body 110 of mount adapter 44 and a respective opening 88 of hand guard 42 allows the accessory mounting adapter 44 to be securely attached to the underlying hand guard 42. Referring to FIGS. 2 and 4, it should be appreciated that one or more of engagement interfaces 64, 66, 68 of hand guard 42 provide an engagement interface that is configured to cooperate with the engagement interface defined by side 118 and projections 134 of accessory mount adapter 44 whereas openings 120, 122 associated with side 116 of body 110 provide a second engagement interface having a different engagement interface configuration than the configuration of the engagement interface associated with the underlying hand guard 42. Said in another way, accessory adapter 44 converts a portion of a longitudinally symmetrical and laterally asymmetrical engagement interface 64, 66, 68 associated with hand guard 42 to a longitudinally and laterally symmetrical engagement interface associated with side 116 of accessory mount adapter 44.

FIGS. 6-9 show various views of accessory mount adapter 46 removed from hand guard 42. Like accessory mount adapter 44, accessory mount adapter 46 is defined by a generally elongated body 140 that extends in a longitudinal direction, indicated by line 142, and that includes an elongate opening 144 formed therein. A first side 146 of body 140 is shaped to define a first engagement interface that is exposed to atmosphere and a second side 148 of body 140 defines a second engagement interface that is also constructed to cooperate with a respective engagement interface 64, 66, 68 defined by hand guard 42.

Figure 8:
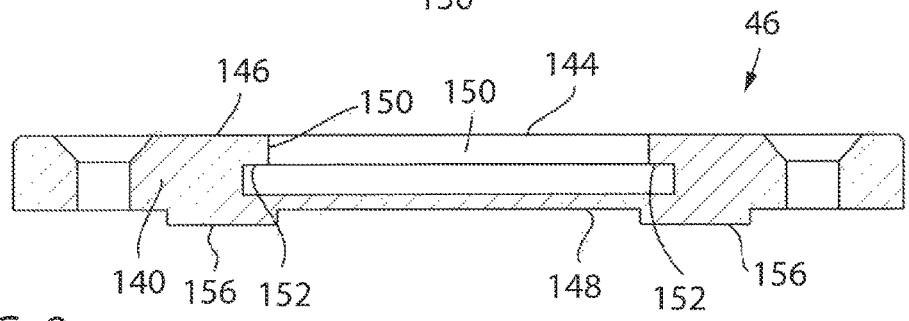
FIG. 8 is a longitudinal cross section view of the accessory mount adapter shown in FIG. 6 taken along line 8-8.
Figure 9:
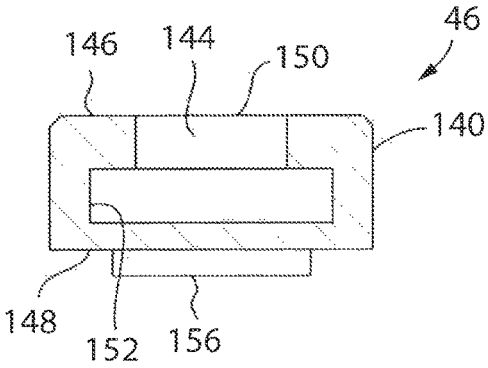
FIG. 9 is a lateral cross section view of the accessory mount adapter shown in FIG. 8 taken along, line 9-9.

Opening 144 is generally defined by a circumferential perimeter 150 and a channel 152 located inboard of perimeter 150 relative to surface 146. As shown in FIG. 8, perimeter 150 generally overlies channel 152 associated with opening 144. Like adapter 44, perimeter 150 and channel 152 associated with opening 144 of adapter 46 allow accessories to be secured to accessory mount adapter 46 via cooperation of the suitably configured accessory mount device with the engagement interface defined by first side 146 of adapter 46. A pair of through openings 154 extend through body 140 in a crossing direction relative to axis 142 and are shaped to receive a fastener associated with securing accessory mounting adapter 46 relative to a respective engagement interface 64, 66, 68 defined by hand guard 42.

Openings 154 preferably include a chamfer or other such recess such that the fasteners associated therewith do not extend beyond the plane defined by surface 146 of body 140. Side 148 of body 140 includes one or more bosses are projections 156 that are shaped and positioned relative to side 148 of body 140 to cooperate with respective openings 88 associated with a respective engagement interface 64, 66, 68 defined by handrail 42 so as to accommodate indexing of the accessory mount adapter 46 relative thereto. When engaged therewith, the overlapping orientation between projection 156 and hand guard 42 assists with the positionally locking of the orientation of adapters 44, 46 relative to the underlying hand guard 42. Like accessory mount adapter 44, accessory mount adapter 46 is also configured to provide a longitudinally and laterally symmetric type of accessory mounting arrangement for accessories engaged therewith and which is securable to a laterally symmetric and longitudinally asymmetric engagement interface associated with an underlying hand guard 42. Said in another way, accessory mounting adapters 44, 46 allow accessories configured for cooperation with a first engagement interface configuration to be secured to a hand guard assembly provided with a different engagement interface configuration.

Although accessory mount adapter 44 is shown with two openings 126 and accessory mount adapter 46 is shown with one opening 144 associated with the engagement interface that is exposed to atmosphere when the respective adapter is secured to an underlying hand guard, it is appreciated that accessory mount adapters having different numbers of discrete openings can be provided. It is further appreciated that adapters of different lengths can be provided and that the though holes associated with securing the respective adapters to the underlying, hand guard can be similarly disposed as opposite longitudinal ends of the respective adapters or position at various locations therebetween. It is further appreciated that such a positioning can be achieved in a number of manners that do not otherwise interfere with the repeating pattern associated with the alternate facing engagement interfaces defined by the respective adapter.

Figure 10:
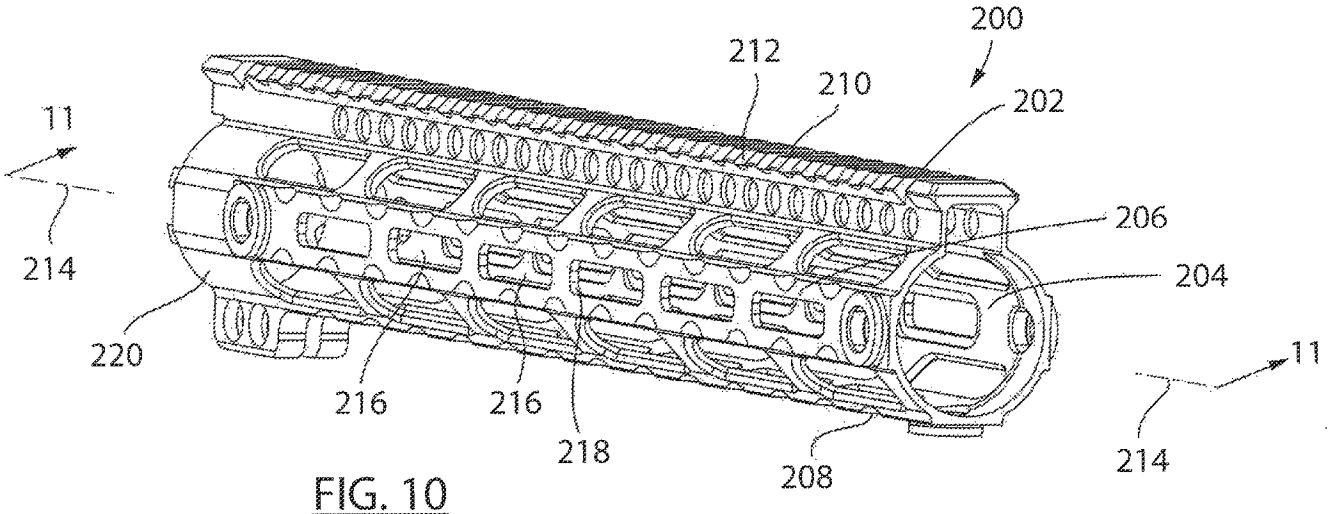
FIG. 10 is a view similar to FIG. 2 of another hand guard usable with the firearm shown in FIG. 1.
Figure 11:
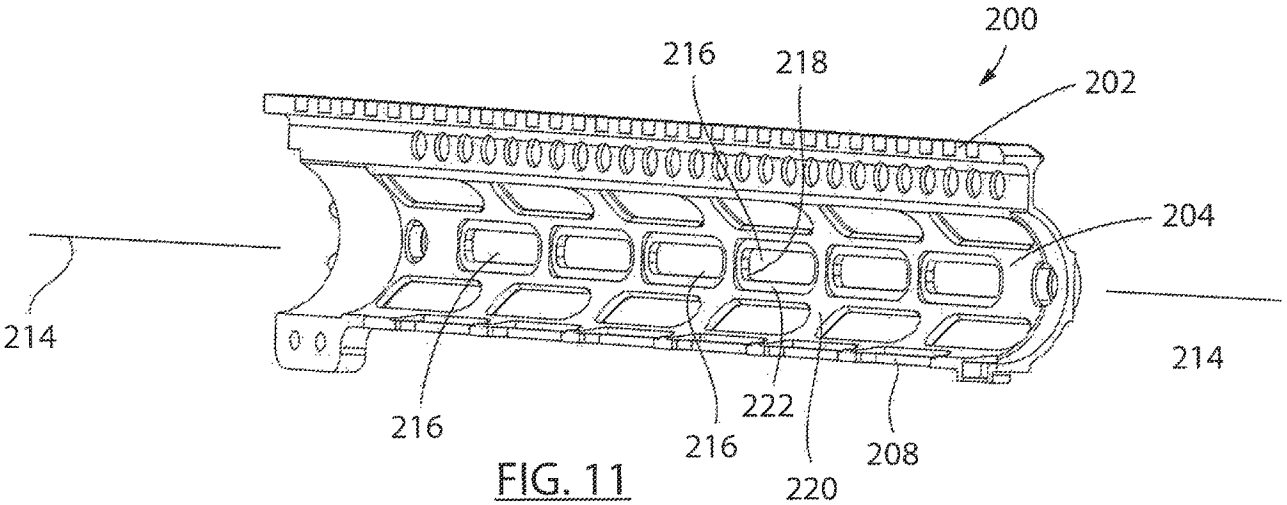
FIG. 11 is a view similar to FIG. 3 of the hand guard shown in FIG. 10.
Figure 12:
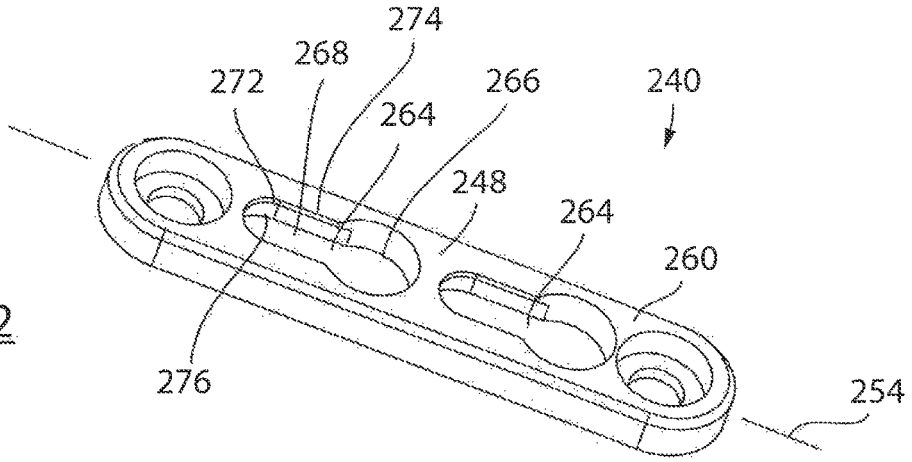
FIGS. 12-19 are various views of various accessory mount adapters according to further embodiments of the invention and which are each configured to removably cooperate with an engagement interface defined by the hand guard shown in FIGS. 10 and 11.
Figure 13:
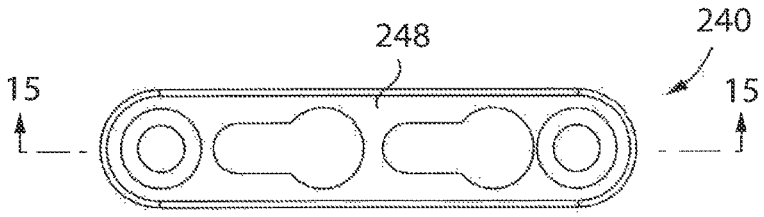
Figure 14:
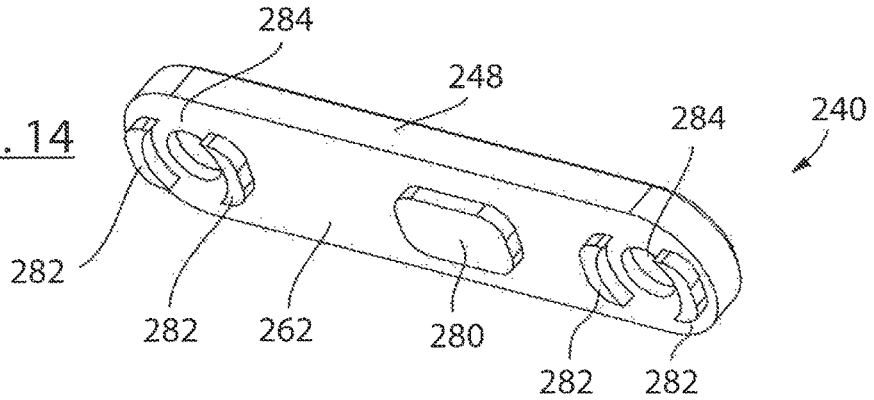
Figure 15:
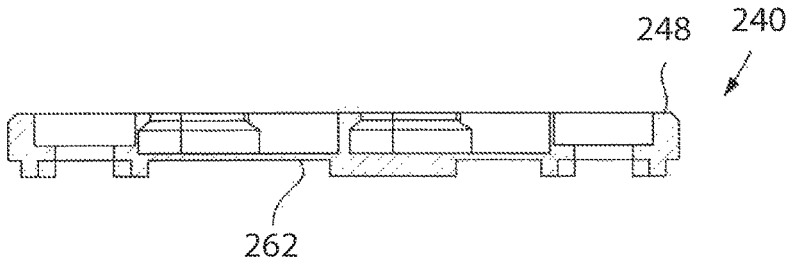
Figure 16:
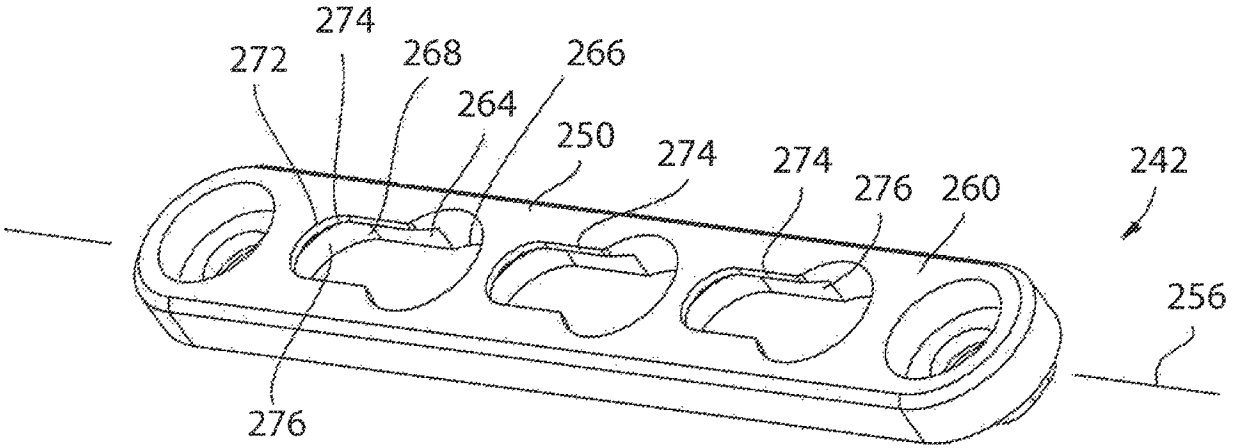
Figure 17:
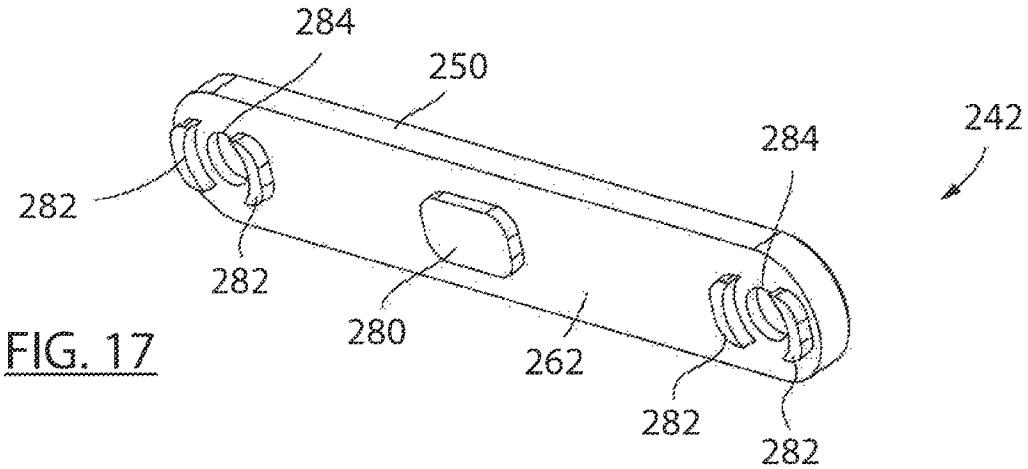
Figure 18:
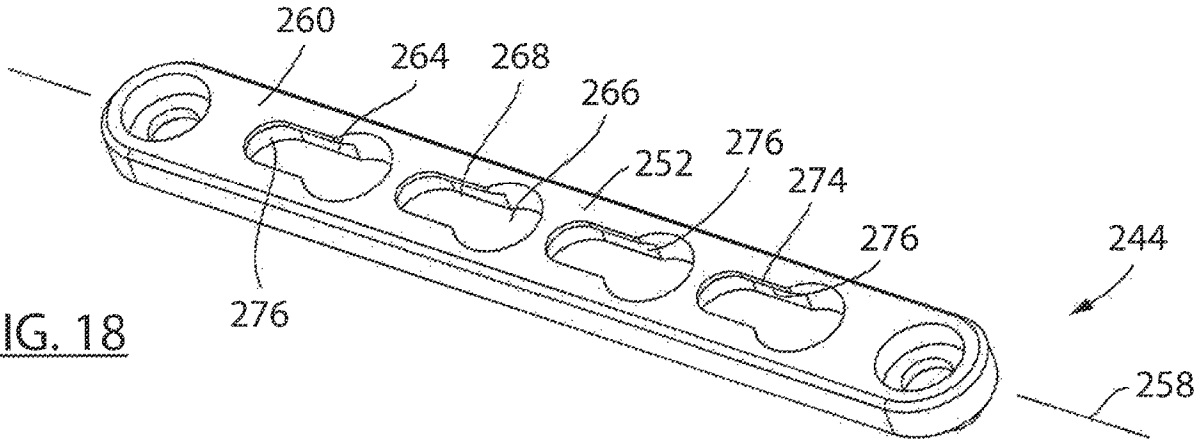
Figure 19:
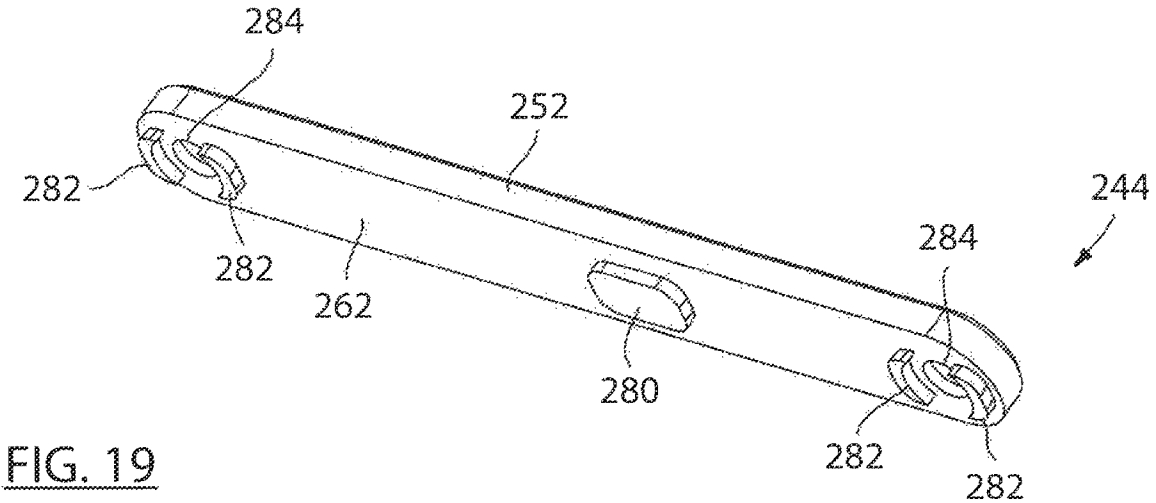

FIGS. 10 and 11 are views of another exemplary hand guard 200 usable with firearm 40. Hand guards 42 and 200 preferably interchangeably cooperate with firearm 40 to facilitate the connection of accessories thereto and to isolate the user from direct contact with the barrel of the firearm. Like hand guard 42, hand guard 200 includes a plurality of engagement interfaces 202, 204, 206, 208 that extend in a longitudinal direction along alternate radial portions of hand guard 200. Like hand guard 42, engagement interface 202 associated with hand guard 200 provides a picatinny rail engagement interface configuration defined by a number of laterally extending ridges 210 and adjacent laterally extending grooves 212 that extend in a repeating pattern in a longitudinal direction, indicated by axis 214, to facilitate the securing of accessories equipped with the picatinny rail engaging mount arrangement to hand guard 200. Like hand guard 42, the non-picatinny rail engagement interfaces are commonly each provided in a common pattern to facilitate reversibility of the association of accessories with firearm 40 for use by left handed and right handed shooters.

One or more of engagement interfaces 204, 206, 208 are defined by a plurality of elongate openings 216 that are oriented in a row such that the longitudinal axis of each opening 216 is aligned with the longitudinal axis of the other openings as well as the longitudinal axis, indicated by line 214, of hand guard 200. Each of openings 216 has a size, shape, and orientation that is similar to openings 120, 122 associated with accessory mounting adapter 44 so as to provide an engagement interface that defined longitudinally and laterally symmetric openings associated with the engagement interface. Each opening 216 is defined by a circumferential perimeter 218 defined by a body 212 of hand guard 200. Referring to FIG. 11, a recess or channel 222 is formed on a radially inward facing side of body 220 of hand guard 200 proximate each opening 216. As explained further below, each opening 216 and channel 222 is constructed to accommodate passage through and cooperation with, respectively, a portion of a nut associated with a fastener configured to secure a respective accessory mounting adapter relative to hand guard 200 wherein the accessory mounting adapter provides a different engagement interface than is provided by the hand guard and which is configured to accommodate securing of accessories or accessory mounting structures relative to hand guard 200.

FIGS. 12-19 show various views of alternate accessory mounting adapters 240, 242, 244 according to further embodiments of the invention. Adapters 240, 242, 244 are each constructed to cooperate with a respective portion of one or more of the engagement interface 204, 206, 208 defined by hand guard 200 and provide an engagement interface having a different construction than that provided by hand guard 200. Each accessory mounting adapter 240, 242, 244 is defined by a body 248, 250, 252 that extends in a generally longitudinal direction, indicated by axis lines 254, 256, 258. Each accessory mounting adapter 240, 242, 244 is defined by a first or top side 260 and a second or bottom side 262 that face opposite lateral directions relative to the respective axis indicated by lines 254, 256, 258.

Top side 260 of each accessory mounting adapter 240, 242, 244 includes one or more openings 264 that are defined by a first portion 266 and a second portion 268 that are offset from one another with respect to each respective opening 264 relative to the respective longitudinal axis 254, 256, 258. It should be appreciated each opening 264 is symmetric relative to the respective longitudinal axis but is asymmetric with respect to a lateral axis that is contained in the plane defined by first side 260 and oriented transverse to the respective longitudinal axis. The second portion 268 of each opening 264 includes a rim or lip 272 that defines a perimeter 274 of each opening 264. An optional groove or channel 276 is generally formed behind each lip 272 and is in open longitudinal fluid communication with the first portion 266 of each respective opening 264. Each opening 264 preferably has a size, shape, and orientation that is the same as openings 88 as disclosed above with respect to engagement interfaces 64, 66, 68 defined by hand guard 42.

Side 262 of each accessory mounting adapter 204, 242, 244 includes one or more bosses or projections 280, 282 that extend in a generally outward direction relative to the surface defined by side 262. One or more of projections 282 are positioned about a through hole or opening 284 formed proximate the opposite longitudinal ends of the respective accessory mount adapter 240, 242, 244. Projections 280, 282 are shaped, sized, and oriented to cooperate with respective openings 216 defined by engagement interfaces 204, 206, 208 of hand guard 200. When engaged therewith, it should be appreciated that surface 262 of respective accessory mounting adapters 240, 242, 244 is maintained in generally abutting cooperation with the exterior surface of the respective engagement surface 204, 206, 208 such that the respective mounting adapter 240, 242, 244 is fully supported relative to the underlying hand guard 200. It is further appreciated that the projections 280, 282 associated with each of a respective accessory mounting adapter 240, 242, 244 are shaped, positioned, and oriented such that each of the respective accessory mounting adapters 240, 242, 244 can reversibly cooperate, via rotation about a direction normal to the longitudinal axis rather than rotation about the longitudinal axis, with the underlying engagement interface. It should be appreciated that such a consideration would manipulate the forward or rearward orientation of the respective portions 266, 268 of openings 264 relative to the underlying hand guard 200 and the firearm 40 associated therewith.

Figure 20:
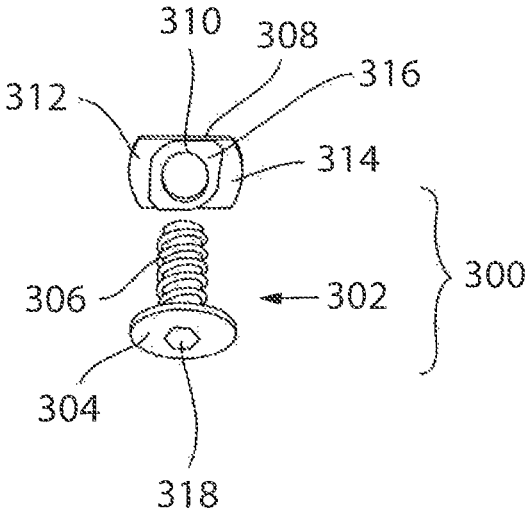
FIG. 20 is a perspective view of an exemplary faster assembly associated with securing a respective accessory mount adapter to an underlying hand guard and/or usable for securing an accessory mount body relative to a respective accessory mount adapter.

FIG. 20 shows a fastener assembly 300 associated with securing one or more of the accessory mounting adapters disclosed above relative to an engagement interface associated with an underlying hand guard. Fastener assembly 300 includes a bolt 302 that is defined by a head portion 304 and a threaded portion 306 and a nut 308. Nut 308 includes a threaded recess 310 that threadingly cooperates with threaded portion 306 of bolt 302. One or more ears 312, 314 extend in an outward radial direction and, as disclosed further below, are shaped to provide an interference fit with a respective channel and lip associated with a respective opening of a respective engagement interface of a respective hand guard 42, 200.

An optional ridge 316 extends in an axial direction associated with threaded portion 306 of bolt 302. Ridge 316 cooperates with the hand guard facing side, such as side 262, of the accessory mounting adapters and has a width that is no wider than the narrowest dimension associated with an opening associated with the engagement interface to which the respective accessory mounting adapter is to be secured. Preferably, ears 312, 314 overlie projections 282 associated with through holes 284 such that, when ears 312, 314, are aligned with the longitudinal axis of a respective opening, or associated with the larger portion of the single direction symmetrical openings of an underlying engagement interface configuration, ears 312, 314 can achieve a position that is laterally inboard of the exterior facing surface of engagement interface associated with an underlying had guard 42, 200. When rotated 90 degrees from an insertion orientation, or rotated to a position wherein ears 312, 314 do not align with the longitudinal axis of the respective opening of the underlying engagement interface, the ears cooperate with a radially inward facing surface of the hand guard such that tightening bolt 302, via interaction with a drive configuration 318, secures the respective accessory mounting adaptor to the underlying hand guard. When tightened, head portion 304 of bolt 302 is preferably captured within a contour of the respective accessory mounting adapter such that bolt 302 is disposed below the atmosphere facing surface of the respective accessory mounting adapter and does not interfere with utilization of any of the engagement interface structures defined by the outward facing side of the respective adapter.

It is appreciated that the various adapters shown herein can be provided in various configurations and can include different numbers of discrete engagement interface structures associated with each respective accessory mounting adapter. It is further appreciated that various securing methodologies can be implemented for securing the discrete accessory mounting adapters to the underlying hand guard assembly. Preferably, each adapter is configured to convert one of a laterally and longitudinally symmetric engagement interface and a longitudinal symmetric and laterally asymmetric engagement interface configuration to the other of the laterally and longitudinally symmetric engagement interface and the longitudinal symmetric and laterally asymmetric engagement interface configuration such that accessories supported by accessory mounting devices that are constructed to cooperate with one of the laterally and longitudinally symmetric engagement interface and the longitudinal symmetric and laterally asymmetric engagement interface configuration can be quickly and conveniently associated with a firearm having a hand guard that is not otherwise equipped for cooperation with such accessory mounting devices. Such considerations accommodate utilization of firearm accessories configured for use with one fire arm hand guard with other firearms that are not equipped with the same hand guard associated with the initial firearm.

The present invention has been described in terms of the preferred embodiments, the several embodiments disclosed herein are related as being directed to the assembly as generally shown in the drawings. It is recognized that equivalents, alternatives, and modifications, aside from those expressly stated, the embodiments summarized, or the embodiment shown in the drawings, are possible and within the scope of the appending claims. It is further appreciated that aspects of the multiple embodiments are not specific to any of the particular embodiment and may be applicable between one or more of the disclosed embodiments. The appending claims cover all such alternatives and equivalents.

What is claimed is:

1. A firearm accessory mount adapter, the adapter comprising:

a hand guard that is securable to a firearm and defines a first engagement interface and at least one opening;

a one-piece adapter body that is defined by a longitudinal axis, the one-piece adapter body having a first side and a second side that are opposite one another and that each extend along the longitudinal axis;

at least one projection extending from the second side of the one-piece adapter body, the at least one projection being shaped to cooperate with the at least one opening defined by the hand guard;

at least one cavity associated with the first side of the one-piece adapter body such that the at least one cavity is defined by a closed radial perimeter defined by the one-piece adapter body;

a passage formed through the one-piece adapter body at a location that is offset along the longitudinal axis from the at least one cavity, the passage being shaped to cooperate with a fastener configured to secure the one-piece adapter body relative to the hand guard; and wherein the second side of the one-piece adapter body is shaped to cooperate with a first engagement interface defined by the hand guard and the first side of the one-piece adapter body defines a second engagement interface that is different than the first engagement interface and wherein both the first and the second engagement interfaces include at least one circumferentially bounded non-circular opening having a shoulder that extends about at least a portion of the circumferentially bounded non-circular opening and defines a channel that extends radially inboard relative to each circumferentially bounded non-circular opening.

2. The adapter of claim 1 wherein the one-piece adapter body further includes a plurality of cavities associated with the first side of the one-piece adapter body that are positioned between the passage and another passage that is shaped to cooperate with another fastener.

3. The adapter of claim 1 wherein the closed radial perimeter of the at least one cavity is symmetric relative to a lateral axis that is perpendicular to the longitudinal axis associated with the at least one cavity.

4. The adapter of claim 1 wherein a first longitudinal end portion of the closed radial perimeter of the at least one cavity is wider than a second longitudinal end portion of the closed radial perimeter.

5. The adapter of claim 1 wherein the at least one cavity passes partially through the one-piece adapter body in a direction transverse to the longitudinal axis.

6. The adapter of claim 1 further comprising another projection extending from the first side of the one-piece adapter body and offset from the at least one projection.

7. The adapter of claim 6 wherein the at least one projection and another projection are spaced from one another to cooperate with discrete openings defined by the hand guard.

* * * * *